United States Patent [19]

Kajita

[11] 4,307,589

[45] Dec. 29, 1981

[54] MAGNETIC LOCK CONSTRUCTION

[76] Inventor: Tomomasa Kajita, 2-3-18, Maruyamadori, Abeno-ku, Osaka-shi, Japan

[21] Appl. No.: 1,410

[22] Filed: Jan. 8, 1979

[30] Foreign Application Priority Data

Jan. 13, 1978 [JP] Japan ..... 53-3241[U]

[51] Int. Cl.[3] ..... E05B 47/00

[52] U.S. Cl. ..... 70/276; 70/1.5; 70/422

[58] Field of Search ..... 70/276, 360, 413, 422, 70/216, 213, 219, 221–224, 1.5, 333 R

[56] References Cited

U.S. PATENT DOCUMENTS

| | | | |
|---|---|---|---|
| 292,095 | 1/1884 | Carlson | 70/422 X |
| 812,905 | 2/1906 | Voight | 70/422 |
| 1,855,697 | 4/1932 | Sullivan | 70/223 |
| 2,036,747 | 4/1936 | Fitzgerald | 70/422 X |
| 2,049,742 | 8/1936 | Lowe | 70/422 X |
| 2,339,980 | 1/1944 | Cloutier | 70/422 X |
| 3,421,348 | 1/1969 | Hallmann | 70/276 |
| 3,566,637 | 3/1971 | Hallmann | 70/276 |
| 3,584,484 | 6/1971 | Hallmann et al. | 70/413 X |
| 3,587,261 | 6/1971 | Berry | 70/422 |
| 3,602,020 | 8/1971 | Kajita | 70/276 |
| 3,782,147 | 1/1974 | Hallmann | 70/276 |
| 3,857,262 | 12/1974 | Sidiropoulos | 70/276 |
| 3,967,479 | 7/1976 | Vick | 70/276 |
| 3,974,669 | 8/1976 | Stackhouse | 70/276 |

FOREIGN PATENT DOCUMENTS

| | | | |
|---|---|---|---|
| 2330014 | 1/1975 | Fed. Rep. of Germany | 70/413 |
| 2807520 | 8/1979 | Fed. Rep. of Germany | 70/276 |

*Primary Examiner*—Ramon S. Britts
*Assistant Examiner*—Carl F. Pietruszka
*Attorney, Agent, or Firm*—McGlew and Tuttle

[57] ABSTRACT

A lock comprises a cylindrical case with a turnable member rotatably mounted therein. A latch member is also rotatably mounted in the case. The latch member is rotatable in a first direction to lock the lock and in an opposite second direction to unlock the lock. A drive member is co-rotatably mounted in the case between and with the turnable member and the latch member. At least one magnetically attractable tumbler is movably mounted on the interior of the turnable member and has a portion which projects into engagement with a receiving cavity of the drive member when the lock is in an unlocked position. This permits the drive member to move axially away from the latch so that rotation of the drive member to rotate the latch to an unlocked position will release the latch.

turnable member and the drive member which is constructed so that it breaks under shearing force before the cam means associated with the drive member breaks, so that the lock cannot be forced open.

3 Claims, 4 Drawing Figures

MAGNETIC LOCK CONSTRUCTION

BACKGROUND OF THE INVENTION

1. Field of the Invention

This application is co-pending with the applicant's related application having Ser. No. 959,598 filed Nov. 13, 1978 and entitled "MAGNETICALLY OPERABLE LOCK", which should be consulted for additional insights into the workings of the invention disclosed herein.

This invention relates in general to the construction of locks and in particular to a new and useful magnetic lock which is openable by a magnet key which has a shear mechanism to prevent rotation of the holding tumblers whenever the lock is not engaged by an unlocking key.

2. Description of the Prior Art

The present invention is an improvement over an invention disclosed and claimed in U.S. patent application Ser. No. 905,048 by the same inventor and now abandoned.

The invention provides a unique lock construction wherein the lock is openable by a magnetic key and wherein it is provided with means to prevent wrongful unlocking of the lock unless it is properly set by the magnetic key.

SUMMARY OF THE INVENTION

In accordance with the invention, there is provided a magnetically openable lock which includes a turnable member which may be engaged by a magnetic key which moves magnetically attracted tumblers so that the lock may be unlocked by driving rotation of a drive member engaged with a latch of the lock. The lock has means insuring that the turning of the turnable member without the proper setting thereof will not effect the unlatching of the latch. The construction includes a pin connection between the rotatable or turnable member and the responding drive member which has a weakened area which will fail due to a shear force prior to the failure of a control cam which limits rotation of the drive member so that the drive member may not be driven to unlatch the lock. The control cam includes another pin carried on a case of the lock which engages in a circumferentially extending groove of the drive member. In the locked position the cam pin prevents the drive member from being displaced axially in respect to the latch by the pin and groove unless the drive member is freed for axial motion by a magnetically actuatable member or tumbler so as to move away from the latch to permit the unlatching thereof due to further rotation of the drive member.

Accordingly it is an object of the invention to provide an improved lock construction in which a lock is openable by a magnetic key which sets an actuating member or tumbler so as to permit displacement of a drive member, by rotation away from a latch which also rotates. The tumblers are carried by the turnable member which is connected to and drives the drive member through a pin connection which may be either radial or axial and which is constructed to break before the control cam for regulating the displacement and turning movement of the drive member breaks.

A further object of the invention is to provide a lock which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1A:
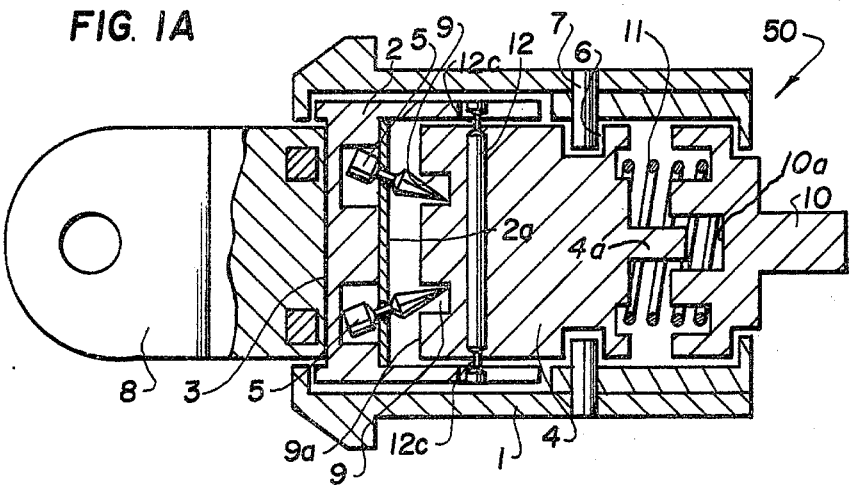
FIG. 1*a* is an axial sectional view of a lock constructed in accordance with the invention.
Figure 1B:
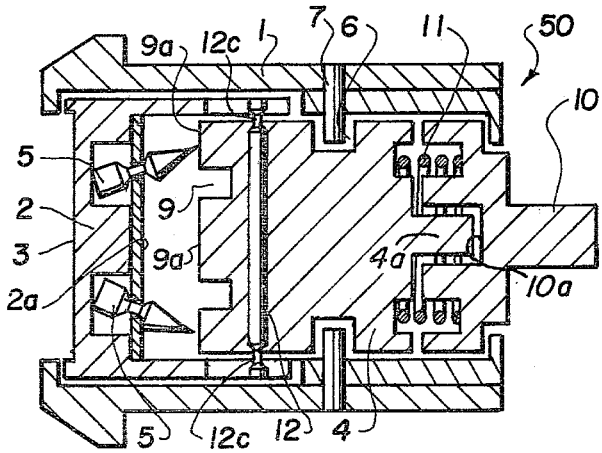
FIG. 1*b* is a view similar to FIG. 1*a* showing the lock in the locked position.

Referring to the drawings in particular, the invention embodied therein in FIGS. 1A and 1B comprises a lock generally designated 50 which includes a latch lever 10 rotatably mounted at one end of case or housing 1 of the lock which is movable in one direction of rotation to position it in a latch position and in an opposite direction of rotation to position it in an unlocked position. A turnable or rotatable member 2 is rotatably mounted in the case 1 adjacent the opposite end from the latch 10 and at least one magnetic actuator or tumbler 5 is pivotally mounted on the interior face of the turnable member 2 and it engages against either a surface 9*a* or a receiving cavity 9 of a drive member 4 which is located in the case between the turnable member and the latch 10. Drive member 4 co-rotates with latch 10 and is axially displaceable with respect to latch 10. Spring 11 disposed between the drive member 4 and the latch 10 biases drive member 4 away from latch 10 toward member 2. Tongue 4*a* extending from member 4 engages into groove 10*a* of latch 10 so that 10 and 4 rotate in common.

The drawings show a hollow cylindrical case 1 provided in its one end with a turnable member 2 fitting therein and having a contact front face 3. The solid cylindrical drive member 4 is fitted at the rear of the turnable member 2 and connected thereto by pin 12. The drive member 4 is movable toward or away from the turnable member 2 as permitted by tumbler 5. The drive member 4 is formed in its outer periphery with a cam groove 6 including spaced apart circumferentially extending straight portions and a connecting oblique or slanting portion between the straight portions for converting a relative turning movement between the drive member 4 and a pin 7 on the case 1 to a straight axial movement. The engaging pin 7 projecting from the inner periphery of the cylindrical case 1 is in engagement with the groove 6. The groove 6 and the pin 7 thus provide cam means for moving member 4 axially with a rotation thereof.

The tumblers 5 are pivotally supported on a wall 2*a* at the rear of the turnable member 2. When a specified magnet key 8 is fitted to the contact face 3, the pivotable tumblers 5 are moved in a direction to engage in cavities 9 of the drive member 4, while when the magnet key 8 is removed from the contact face 3, the tumblers 5 return to a position in which they can provide abutting contact with the face of the drive member 4 bordering the cavities 9 at 9a.

It is of course desirable to provide a plurality of pivotable pieces 5 to add to the safey of the lock, although only two pieces 5 are shown in FIGS. 1 and 2.

Tumblers 5 jam when spring 11 biases pin 7 into the oblique part of the slot 6 with return rotation of the members (2,4,10) i.e., in an unlatching direction. They are freed to swing without interference with either of cavities 9 or face 9a only with rotation of the members (2,4,10) in the latching direction during which the inner or latch-side wall of the oblique part of groove 6 rides against pin 7 to cam driver 4 axially against the bias of spring 11 toward latch 10 and away from such tumblers 5 at least until face 9a is beyond the arcs in which they swing.

Figure 2A:
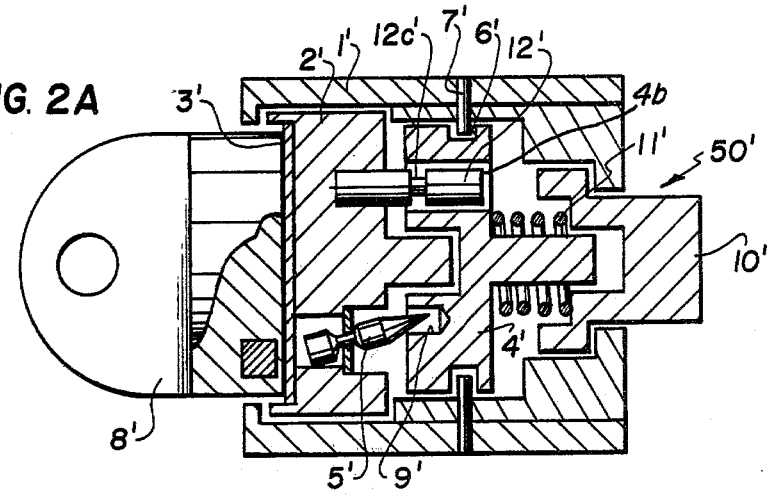
FIG. 2*a* is a view similar to FIG. 1*a* showing another embodiment of the invention.
Figure 2B:
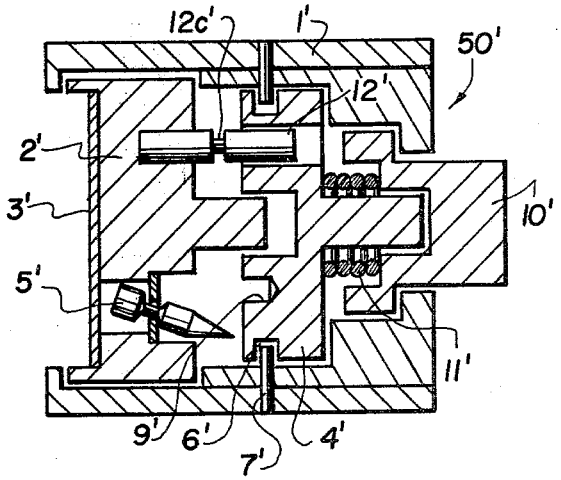
FIG. 2*b* is a sectional view similar to FIG. 2*a* showing the lock in a locked position.

Latch lever 10 in engagement with the solid cylindrical drive member 4 by the axial overlap of part 4a into slot 10a, and with spring 11 provided therebetween is supported at the rear end of the case 1. The drive member 4 is movable toward or away from the latch lever 10 by pin 7 riding in the oblique part of groove 6. The pin 12 for connecting the drive member 4 to a rear portion of the turnable member 2 extends diametrically of the drive member 4 as seen in FIGS. 1A and 1B or is provided in parallel to the axis of the drive member 4 as shown in FIGS. 2A and 2B. In either of the embodiments, the pin 12 has a necked portion 12c of reduced diameter where the drive member 4 and the turnable member 2 are coupled to each other. The necked portion 12c has a lower shear strength than the engaging pin 7 which, with groove 6, constrains member 4 axially.

The magnetic key 8, when fitted to the contact face 3, moves the tumblers 5 in a direction to engage the pieces into the cavities 9. When the magnet key 8 in this position is turned in an unlocking direction, the drive member 4 rotates with the turnable member 2 under the action of the spring 11 biasing the drive member 4 toward the member 2, thereby altering the position of the cam groove 6 of the drive member 4 relative to the engaging pin 7. With the engaging pin 7 coming into engagement with the slanting groove portion (not shown) of the cam groove 6, the drive member 4 moves axially toward the turnable member 2. As shown in FIG. 1A or 2A, when the key 8 is further turned in the unlocking direction, the latch lever 10 can be turned in the unlocking direction with the engaging pin 7 in engagement with the straight groove portion of the cam groove 6 (not shown). If the magnet key 8 is turned in the opposite direction to the above, the latch lever 10 is turnable in a locking direction in a manner reverse to the above, with the shift of the cam groove 6 relative to the pin 7 moving the drive member 4 away from the turnable member 2.

When the magnet key 8 is then removed from the contact face 3, the tumblers 5 return to hit the surface 9a adjacent the cavities 9 with the result that the drive member 4 is held away from the turnable member 2 to maintain the locked state.

Even if a magnet key other than the one specified for the present device is fitted to the contact face 3 while it is in the locked state, the pieces 5 will not move toward the openings of the cavities 9. With drive member 4 thus prevented from moving axially, pin 7 will not be able to enter the oblique part of groove 6. This limits the rotation of drive member 4 and the rotatable member 2. When it is attempted to forcibly further turn the member 2 as with a screwdriver, the pin 12 will be broken at the necked portion 12c, freeing the drive member 4 from the turnable member 2. It is therefore impossible to further rotate the latch lever 10 through drive member 4.

The conventional magnetic locks of this type have the drawback that when the drive member within the lock is forcibly turned as by a screwdriver, the lock is wrongfully unlockable or, even if the lock is not unlockable, the portion where the internal drive member is in engagement with an engaging member is liable to be damaged.

According to the present invention, however, the pin 12 coupling the turnable member 2 to the drive member 4 has a necked portion 12c which has a lower strength than the pin 7, so that when it is attempted to forcibly unlock the lock with some means other than the specified magnet key 8, the pin 12 is broken at the necked portion 12c, uncoupling the drive member 4 from the member 2 and rendering the lock unlockable as already stated. Additionally such an attempt, if made, will cause no damage whatever to the internal other members, and the lock becomes reusable when the pin 12 is replaced. Thus the present invention greatly adds to the usefulness of magnetic locks.

In the embodiment of the invention shown in FIGS. 2A and 2B of the drawings, there is provided a lock generally designated 50' in which similar parts are similarly designated with the addition of primes to the numbers. In this embodiment the drive pin 12' extends axially between the turnable member 2' and the drive member 4' and into an opening shown in 4'. In other respects the locks are substantially identical.

While specific embodiments of the invention have been shown and described in detail to illustrate the application of the principles of the invention, it will be understood that the invention may be embodied otherwise without departing from such principles.

What is claimed is:

1. A magnetically operable lock comprising a casing having an open inner end and an opposite open outer end, a latch member rotatably mounted in said casing adjacent said outer end, a drive member rotatively mounted and axially movable in said casing having a cylindrical sidewall in slidable engagement with said case, groove means defined between said drive member and said case for controlling the axial and rotational movement of said drive member relative to said latch member and including a groove defined on one of said drive members and said case and a cam pin carried by the other of said drive member and said case engaged in said groove, a spring disposed between said drive member and said latch member biasing said drive member and said latch member apart, said latch member being rotatable with said drive member, a turnable member rotatably mounted in said casing adjacent said open inner end, connecting pin means interconnecting said turnable member and said drive member for rotation together but permitting relative axial displaceable movement therebetween, at least one pivotally movable tumbler carried on said turnable member and having an actuation position in which said tumbler is directed toward said drive member, said drive member having an end face facing said tumbler with a receiving cavity thereon into which said tumbler extends in the actuation position, said tumbler disposable in abutting relationship with said end face when said tumbler is in a non-actuated position to block axial motion of said drive member, magnetic key means engageable with said turnable member and being rotatable therewith and housing a magnet for attracting said tumbler into actuated position in said receiving cavity on said end face of said drive member, rotation of said drive member with said turnable member being effective to move said drive member axially by the action of said groove and cam pin in a direction toward said latch member, to further rotate said latch member upon subsequent turning movement of said key, rotation of said latch member being limited by said cam pin in said groove when said tumbler is in said nonactuated position to block axial motion of said drive member, said connecting pin means comprising a breakable pin having a weakening between said turnable and drive members which breaks before said cam pin breaks when said turnable member is forcibly turned with said tumbler in its non-actuated position so that interconnection between said turnable member and said drive member is broken.

2. A lock according to claim 1 wherein said breakable pin extends substantially axially between said turnable member and said drive member.

3. A lock according to claim 1, wherein said breakable pin extends substantially radially between said drive member and said turnable member, said turnable member having means for receiving and permitting axial movement of said drive pin relative to said drive member.

* * * * *